US009318841B2

(12) United States Patent
Gimbel et al.

(10) Patent No.: US 9,318,841 B2
(45) Date of Patent: Apr. 19, 2016

(54) CONNECTOR ASSEMBLY WITH CHAMBER BLOCK AND CONTACT POSITION ASSURANCE

(71) Applicant: Tyco Electronics AMP GmbH, Bensheim (DE)

(72) Inventors: Markus Gimbel, Freystadt/Burggriesbach (DE); Stefan Ernst Glaser, Heppenheim (DE); Kai Sellien, Lampertheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 179 days.

(21) Appl. No.: 14/134,254

(22) Filed: Dec. 19, 2013

(65) Prior Publication Data

US 2014/0106597 A1 Apr. 17, 2014

Related U.S. Application Data

(63) Continuation of application No. PCT/EP2012/061286, filed on Jun. 14, 2012.

(30) Foreign Application Priority Data

Jun. 23, 2011 (DE) ..... 10 2011 051 291

(51) Int. Cl.

| | |
|---|---|
| ***H01R 13/62*** | (2006.01) |
| ***H01R 13/422*** | (2006.01) |
| ***H01R 13/436*** | (2006.01) |
| ***H01R 13/506*** | (2006.01) |
| ***H01R 13/52*** | (2006.01) |

(52) U.S. Cl.

CPC ..... *H01R 13/62* (2013.01); *H01R 13/4223* (2013.01); *H01R 13/4361* (2013.01); *H01R 13/506* (2013.01); *H01R 13/5202* (2013.01)

(58) Field of Classification Search

CPC . H01R 13/4223; H01R 13/4364; H01R 13/62
USPC ..... 439/352, 345, 595, 752
See application file for complete search history.

(56) References Cited

U.S. PATENT DOCUMENTS

| | | | | |
|---|---|---|---|---|
| 4,973,268 | A * | 11/1990 | Smith et al. | 439/595 |
| 5,004,436 | A * | 4/1991 | Aoyama | 439/752 |
| 5,326,287 | A * | 7/1994 | Hamakita et al. | 439/752 |
| 6,171,130 | B1 * | 1/2001 | Yoshida et al. | 439/352 |

(Continued)

FOREIGN PATENT DOCUMENTS

| | | |
|---|---|---|
| EP | 1073155 A2 | 1/2001 |
| EP | 1176670 A1 | 1/2002 |

OTHER PUBLICATIONS

PCT Notification and International Search Report and the Written Opinion of the International Searching Authority, dated Sep. 12, 2012, 9 pages.

PCT International Preliminary Report on Patentability and Written Opinion of the International Searching Authority for International application No. PCT/EP2012/061286, dated Dec. 23, 2013, 5 pages.

(Continued)

*Primary Examiner* — Briggitte R Hammond
(74) *Attorney, Agent, or Firm* — Barley Snyder

(57) ABSTRACT

A plug type connector is provided with chamber block. The chamber block includes a receiving chamber and a recess that intersects with the receiving chamber. The receiving chamber extends a length of the chamber block and includes a contact securing member with a catch. The recess includes an opening into which the catch protrudes into.

11 Claims, 6 Drawing Sheets

(56) References Cited

U.S. PATENT DOCUMENTS

| | | | | |
|---|---|---|---|---|
| 6,579,118 | B2 * | 6/2003 | Endo | 439/489 |
| 6,827,609 | B1 * | 12/2004 | Martin et al. | 439/595 |
| 7,625,251 | B2 | 12/2009 | Martin et al. | |
| 7,914,327 | B2 | 3/2011 | Campbell et al. | |
| 2002/0187676 | A1 | 12/2002 | Kurimoto et al. | |
| 2005/0176298 | A1 * | 8/2005 | Flowers et al. | 439/595 |
| 2005/0266738 | A1 | 12/2005 | Martin et al. | |
| 2009/0081908 | A1 * | 3/2009 | Martin et al. | 439/752 |
| 2009/0269963 | A1 | 10/2009 | Brown et al. | |

OTHER PUBLICATIONS

PCT Notification Concerning Transmittal of International Preliminary Report on Patentability for International application No. PCT/EP2012/061286, dated Jan. 9, 2014, 1 page.

English translation of the First Office Action, App. No. 201280031110.3, dated Aug. 21, 2015, 10 pages.

Proposed Amendment, Chinese Patent Application No. 201280031110.3/First Office Action, 3 pages.

Office Action, App. No. 201280031110.3, dated Aug. 21, 2015, 8 pages.

* cited by examiner

CONNECTOR ASSEMBLY WITH CHAMBER BLOCK AND CONTACT POSITION ASSURANCE

CROSS-REFERENCE TO RELATED APPLICATIONS

This application is a continuation of PCT International Application No. PCT/EP2012/061286 filed Jun. 14, 2012 which claims priority under 35 U.S.C. §119 to German Patent Application No. 10 2011 051 291.8 filed Jun. 23, 2011.

FIELD OF INVENTION

The invention relates to a connector and, in particular, to a plug type connector.

BACKGROUND

Plug type connectors having a chamber block with a receiving chamber extending through the chamber block to secure an electrical contact element are generally known and are used, for example, in the automotive field, in particular for connecting sensors to control devices of the motor vehicle. In this instance, it is often necessary to construct the plug type connector to be as small as possible and nonetheless to provide it with the contact securing member. In particular, it is difficult to construct the chamber block with small dimensions and with the contact securing member in such a manner that it can be readily removed as an injection-molded component from an injection mold. Removal from the injection mold is often made more difficult by the contact securing member since the member has a concealed undercut. In order to remove the plug type connector or the components thereof from the mold, either the injection mold is constructed in a complex and consequently cost-intensive manner or the plug type connector is removed from the mold in such a manner that the contact securing member is impaired in terms of its function.

SUMMARY

An object of the invention, among others, is therefore to provide a plug type connector which has a contact securing member and which can readily be removed from an injection mold which is constructed in a comparatively simple manner.

The includes chamber block with a receiving chamber and a recess that intersects with the receiving chamber. The receiving chamber extends a length of the chamber block and includes a contact securing member with a catch. The recess includes an opening into which the catch protrudes into.

BRIEF DESCRIPTION OF THE DRAWINGS

The invention is explained below by way of example with reference to embodiments and the drawings. The various features of the configurations can be combined independently of each other, as has already been set out in the individual advantageous configurations. In the drawings.

DETAILED DESCRIPTION OF THE EMBODIMENT(S)

The structure and/or function of a plug type connector according to the invention are first described with reference to the embodiment of FIG. 1.

Figure 1:
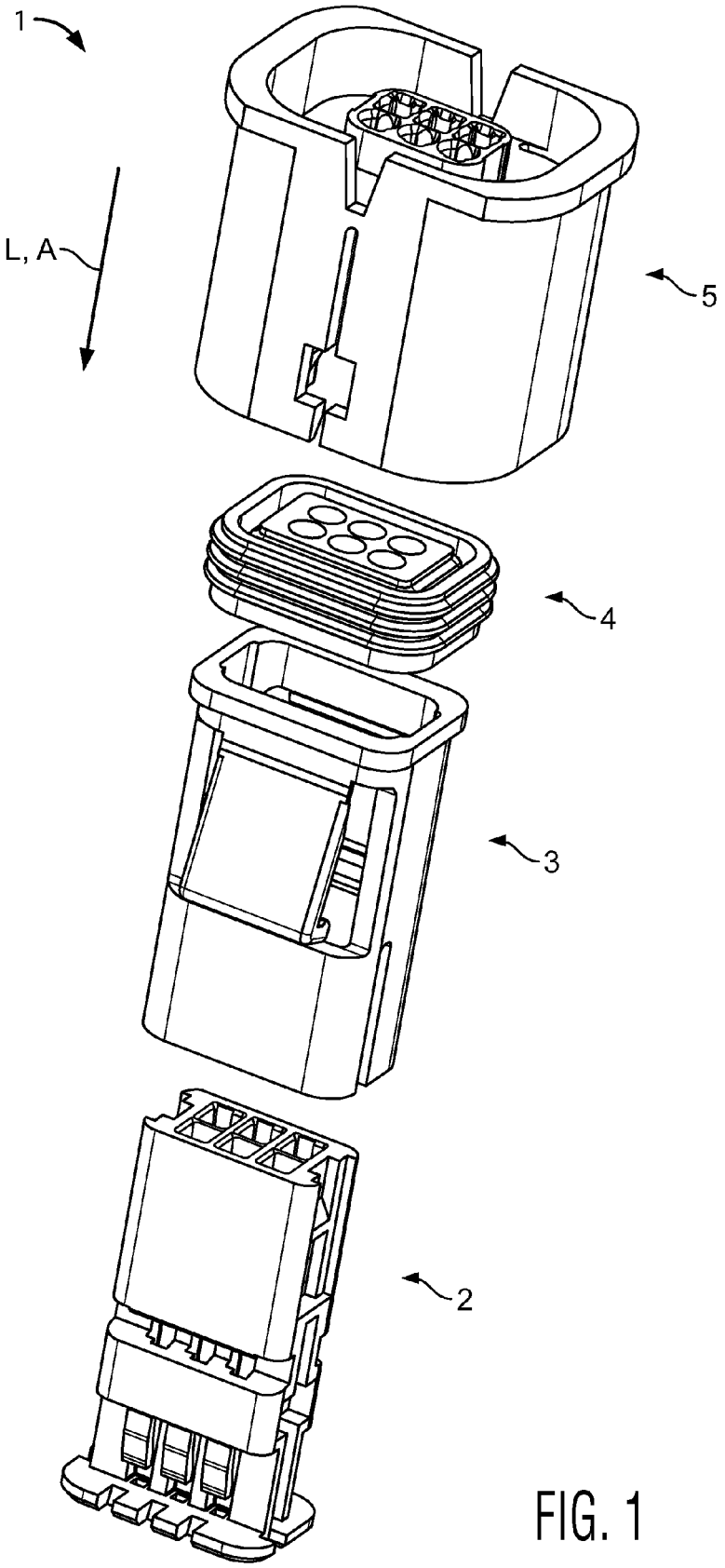
FIG. 1 is an exploded perspective view of a plug type connector according to the invention.

As shown in FIG. 1, a plug type connector 1 according to the invention includes a chamber block 2, a fixing member 3, a seal 4, and a housing 5. The components may be pushed into or over each other in the shown sequence so that the components 2 to 5 can be arranged inside to perform an assembly of the plug type connector 1. Thus, the chamber block 2 may be inserted into the fixing member 3. The housing 5 can be pushed onto the fixing member 3. The seal 4 can be inserted into the housing 5 in such a manner that it is arranged at least partially between the housing 5 and the fixing member 3. The components which are each pushed into another component may protrude from the other component, which at least partially surrounds them.

The chamber block 2 may be configured to join with contact elements of a connecting plug type connector. Contact elements of the plug type connector 1 may be inserted into the chamber block 2 and extend parallel with a longitudinal direction L of the plug type connector. The contact elements or the conductors which are fixed thereto extend through the chamber block 2, the fixing member 3, the seal 4 and/or the housing 5.

Now with reference to FIGS. 2 to 6, the components of the plug type connector will be further described.

Figure 2:
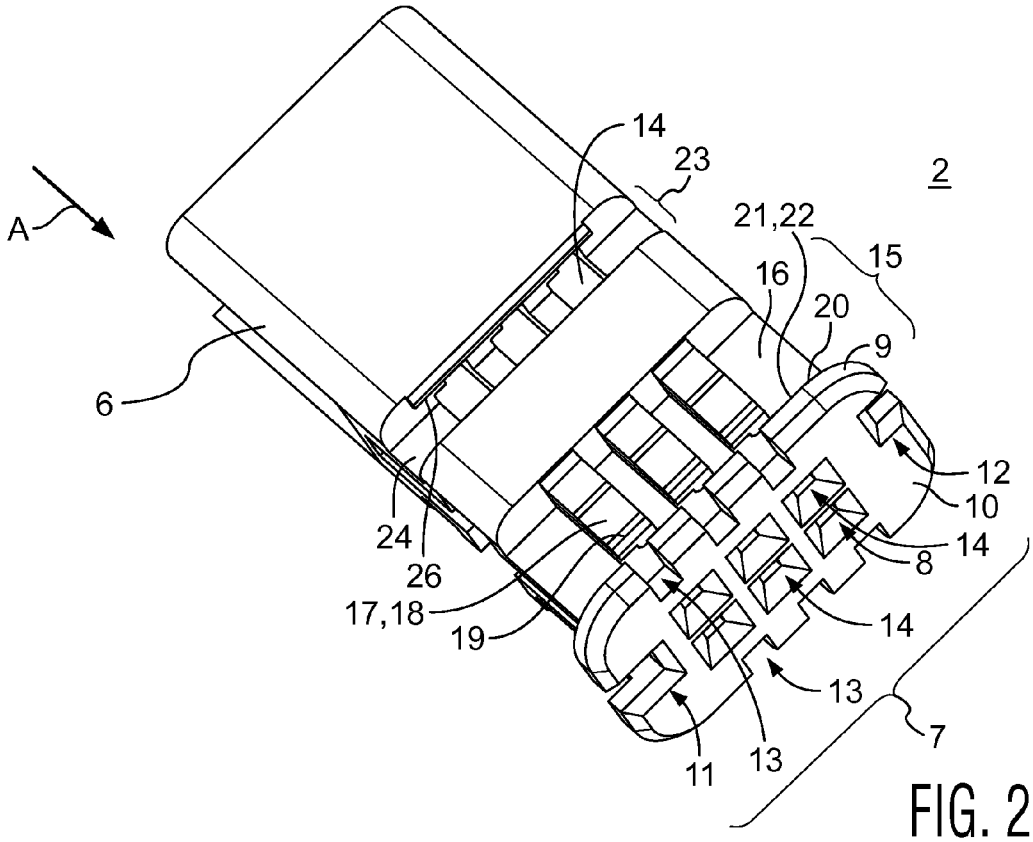
FIG. 2 is a perspective view of a chamber block of the plug type connector of FIG. 1.

As shown in FIG. 2, the chamber block 2 may be constructed with a substantially parallelepipedal base member 6. A plug face 7 of the plug type connector 1 may be arranged at an end of the chamber block 2 directed in the receiving direction A. In the plug face 7, a contact opening 8 for receiving a counter-contact of the connecting plug type connector may be arranged. Alternatively, the contact element which is arranged in the chamber block 2 may protrude through the contact opening 8 in a receiving direction A from the chamber block 2. The chamber block 2 may have more than one contact opening 8 and, for example, two, four or up to six or even more contact openings 8.

The plug face 7 may adjoin, transversely relative to the receiving direction A, a closure collar 9 which may protrude perpendicularly relative to the receiving direction A from the base member 6 of the chamber block 2. The plug face 7 and the closure collar 9 may be part of a closure plate 10 of the chamber block 2 that extends transversely relative to the receiving direction A.

The chamber block 2 may be constructed with keyed and/or coding elements 11, 12 which prevent incorrect insertion, for example, in an incorrect position or with an incorrect mating connector. For example, the keyed and/or coding elements 11, 12 may extend parallel with the receiving direction A and, for example, be constructed as keyed and/or coding grooves which extend through the closure plate 10 counter to the receiving direction A.

Furthermore, the plug type connector 1 may have a access opening 13 which is associated with one of the contact openings 8 and which may be arranged to be spaced apart therefrom transversely relative to the receiving direction A. Such an access opening 13 may be associated with each of the contact openings 8. The access opening 13 may be constructed in such a manner that the inside of the chamber block 2 is accessible through the respective access opening 13 parallel with and particularly counter to the receiving direction A. For example, the access opening 13 may be arranged in the closure collar 9 as a gap which can open transversely relative to the receiving direction A.

A receiving chamber 14 for a contact element may extend through the chamber block 2 parallel with the receiving direction A and may terminate at the contact opening 8. A receiving chamber 14 may terminate at one of the contact openings 8 and open with respect thereto, respectively, the contact opening 8 being able to have a smaller diameter transversely relative to the receiving direction A than the receiving chamber 14 which terminates at it.

The receiving chamber 14 may extend completely through the chamber block 2 counter to the receiving direction A and may be open in and counter to the receiving direction A. The receiving chamber 14 may be adapted to receive the contact element which may be constructed, for example, as an electrical contact element.

The parallelepipedal base member 6 may have a recess 15 which is constructed in a channel-like manner and is constructed to be open transversely relative to the receiving direction A. The recess 15 may adjoin the closure collar 9 in the receiving direction A and extend transversely relative to the receiving direction A through the chamber block 2. The recess 15 may intersect with the a receiving chamber 14 and in particular extend at least partially through it. A base 16 of the recess 15 may extend so deeply through the chamber block 2 transversely relative to the receiving direction A that it merges in a stepless manner into the receiving chamber 14.

If the chamber block 2 has a plurality of receiving chambers 14, at least some of the receiving chambers 14 may be arranged to be in alignment with each other transversely relative to the receiving direction A. The recess 15 may be constructed in such a manner that it extends through the receiving chambers 14 which are in alignment with each other in a substantially uniform manner.

The chamber block 2 may be constructed with a contact securing member 17 in the region of the recess 15. The contact securing member 17 may includes a catch 18 per receiving chamber 14. The catch 18 is constructed as a cantilever member which extends in the receiving direction A and whose free end 19 protrudes into the receiving chamber 14 which is associated therewith. The catch 18 may be resiliently deflectable transversely relative to the receiving direction A and in particular perpendicularly relative to the base 16 of the recess 15.

The chamber block 2 may be constructed with a securing portion 20 between the catch 18 and the closure collar 9. The securing portion 20 prevents undesirable removal of the contact element counter to the receiving direction A. The securing portion 20 prevents the contact element from being able to be displaced or pulled beyond a predetermined position, for example, when a plug type connection with respect to the connecting plug type connector is disengaged. Movement can be prevented by means of the catch 18. The closure plate 10 or the closure collar 9 may be constructed with a stop 21 for the contact element. The stop 21 is preferably arranged along a rear side 22 of the closure collar 9 extending transversely relative to the receiving direction A and directed counter to the receiving direction A. The rear side 22 may be arranged opposite the plug face 7. In particular, the stop 21 may adjoin the contact opening 8 and surround it transversely relative to the receiving direction A.

The plug type connector 1 may further have an additional contact securing member which is provided in a redundant manner with respect to the contact securing member 17. For the additional contact securing member, the chamber block 2 may have an additional recess 23 which at least partially intersects with the a receiving chamber 14. The additional recess 23 may extend parallel with the recess 15 and the recesses 15, 23 may be arranged one behind the other in the receiving direction A. In particular, the additional recess 23 may be arranged upstream of the recess 15 in the receiving direction A so that a contact element which is pushed into the chamber block 2 in a receiving direction A first passes the additional recess 23 on its way to the end position thereof and is pushed into the recess 15 only afterwards.

The additional recess 23 may be formed transversely relative to the receiving direction A such that the base 24 thereof merges in a planar manner into the receiving chamber 14. Alternatively, the receiving chamber 14 may extend in the region of the additional recess 23 as a channel 25 through the base 24 of the additional recess 23. The channel 25 may extend in the receiving direction A as far as the closure collar 9, that is to say, also through the base 16 of the recess 15.

The chamber block 2 may be constructed with a catch 26 for securing the additional contact securing member. The catch 26 may be formed, for example, as a catch web which extends transversely relative to the receiving direction A and which protrudes in or counter to the receiving direction A into the additional recess 23. The catch 26 may extend over the a receiving chamber 14 or, if a plurality of receiving chambers 14 are provided, over at least two, three or even all the receiving chambers 14 which are arranged beside each other or in alignment with each other.

Figure 3:
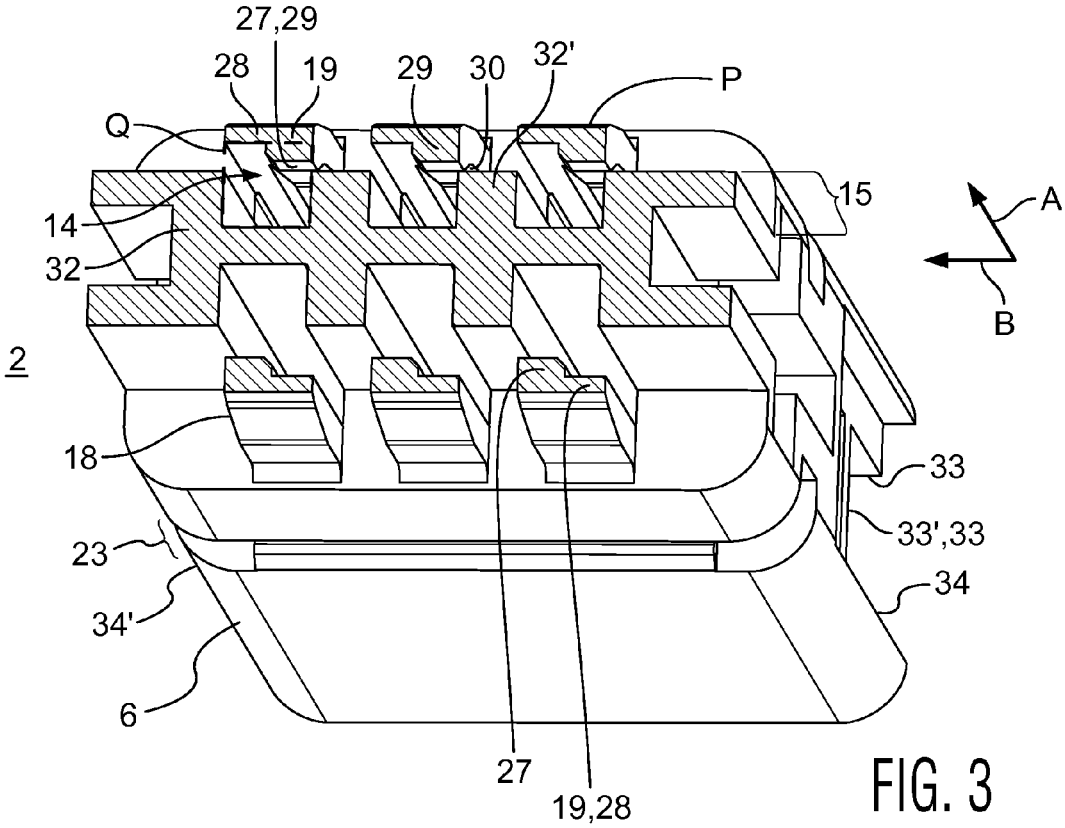
FIG. 3 is another perspective view of the chamber block of the embodiment of FIG. 2, showing a section thereof.

Now with reference to FIG. 3, the receiving chamber 14 has a substantially square cross-section Q transversely relative to the receiving direction A.

A plurality of the receiving chambers 14 may be arranged beside each other and in particular in alignment with each other along a transverse direction B which extends perpendicularly relative to the receiving direction A. The catch 18 may also be arranged beside each other in the transverse direction B and may be able to be deflected or deformed perpendicularly relative to the receiving direction A and the transverse direction B. In particular, at least the free ends 19 of the catch 18 which are constructed as catch tongues may be able to be resiliently deflected away from the chamber block 2 transversely relative to the directions A, B.

The free ends 19 of the catch 18 may have at least two portions which are arranged one behind the other in the transverse direction B. One of the portions may be formed as a catch portion 27 and the other portion as an actuation portion 28. At least the catch portion 27 may protrude into the receiving chamber 14 in the shown rest position P of the catch 18. The catch portion 27 may be constructed with a catch hook 29 which may protrude into the receiving chamber 14 with respect to the actuation portion 28 and transversely relative to the directions A, B. The catch hook 29 may be constructed counter to the receiving direction A with an inclined introduction member 30 for the contact element and, in the receiving direction A, may have a retention face 31 for the contact element that extends substantially transversely relative to the directions A, B. The actuation portion 28 may also protrude into the receiving chamber 14 in the rest position of the catch 18, but not as far as the catch portion 27 does.

The actuation portion 28 may be arranged along the receiving direction A, downstream of and accessible through the access opening 13. The connection between the contact securing member 17 which is constructed as a catch 18 and the contact element may be released, for example, using a release member. The release member can be inserted through the access opening 13 and press at least the free end 19 of the catch 18 out of the receiving chamber 14 transversely relative to the directions A, B. Consequently, a contact element which may be defective can be readily exchanged without the plug type connector having to be disassembled.

The receiving chambers 14 may be separated from each other using partitions 32, 32' which extend in the receiving direction A. A partitions 32 may extend parallel with the directions A, B and separate from each other two groups of receiving chambers 14 which are each arranged beside each other or in alignment with each other in the transverse direction B. The partitions 32' may extend perpendicularly with respect to the transverse direction B and into the recess 15 in which they may terminate. Two partitions 32' may flank one of the receiving chambers 14 in each case.

The keyed and/or coding elements 11, 12 may also extend through partitions 32, 32' in a state delimited counter to the receiving direction A by the base member 6.

The chamber block 2 may be constructed with a catch portion 33 for securing the chamber block 2 in the plug type connector 1 upstream of the plug face 7. The catch portion 33 may be provided, for example, along sides 34, 34' of the chamber block 2 and in particular the base member 6 thereof directed in and counter to the transverse direction B, with catches, for example, with a catch projection 33' or a catch recess.

Figure 4:
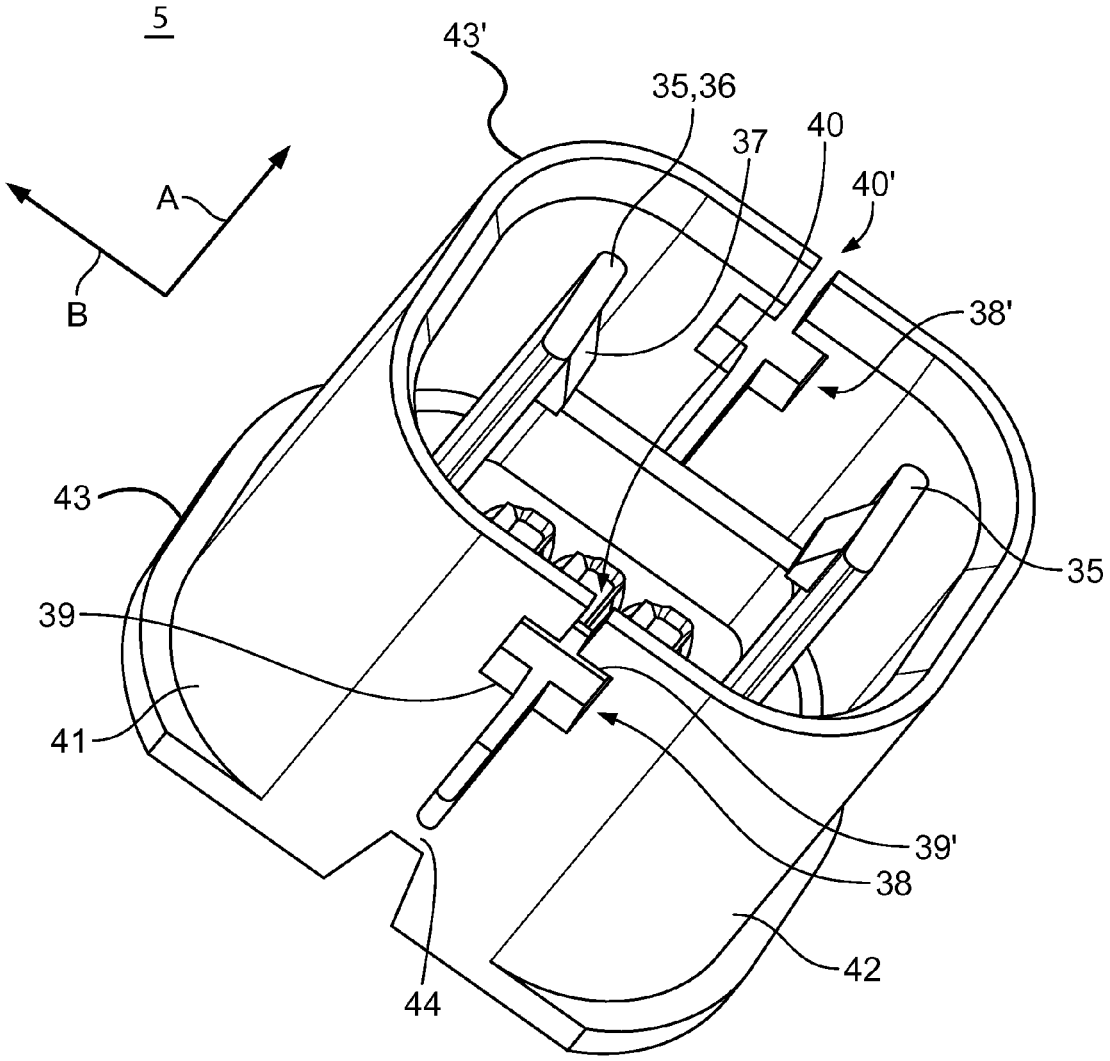
FIG. 4 is a, perspective view of a housing of the plug type connector of FIG. 1.

Now with reference to FIG. 4. the housing 5 is shown and may include two catch arm(s) 35 for securing the housing 5 to one of the other components 2 to 4. The catch arms 35 may particularly be constructed in such a manner that they can engage with the catch portion 33 of the chamber block 2. In the region of a free end 36 of the a catch arm 35 that is directed in the receiving direction A, the catch arm 35 may be constructed with a catch 37 which is constructed to produce a catch connection with the catch portion 33. In particular, the catch 37 may be constructed as a catch hook which protrudes in the transverse direction B. If a plurality of catch arms 35 are provided, the catches which are constructed as catch hooks may protrude, for example, transversely relative to the receiving direction A towards each other or away from each other.

The housing 5 may engage with the connecting plug type connector. The housing 5 may be formed with a catch member 38. For example, the catch member 38 may have a catch recess 39 which extends transversely relative to the receiving direction A and in or counter to the transverse direction B. For uniform transmission of force, the catch member 38 may have two catch recesses 39, 39' which extend away from each other in or counter to the transverse direction A, respectively. The catch recesses 39, 39' may open transversely relative to the receiving direction A to form a separation gap 40 which may extend parallel with the receiving direction A through the housing 5. The catch recesses 39, 39' are arranged along the separation gap 40 at the same height or facing each other in the shown embodiment.

The separation gap 40 can separate two outer shells 41, 42 of the housing 5 from each other. The housing 5 may be divided asymmetrically by the separation gap 40. According to the embodiment of FIG. 4, however, the outer shells 41, 42 may also be formed as half-shells. Furthermore, the outer shells 41, 42 may be separated from each other by another separation gap 40' which has an additional catch member 38' in its path.

The separation gap 40 and also the separation gap 40' may extend through an actuation portion 43 of the housing 5. The actuation portion 43 may be arranged upstream of the catch member 38 and also upstream of the catch member 38'. The housing 5 may be constructed in such that compressing the separation gap 40, 40' in the region of the actuation portion 43 leads to opening of the catch member 38, 38'. To this end, the housing 5 can have a resiliently deformable material bridge 44 per separation gap 40, 40' which bridges the respective separation gap 40, 40' and which can connect the outer shells 41, 42 to each other in an articulating manner. Owing to the material bridge 44, the housing 5 may thus be constructed in a pliers-like manner. The material bridge 44 may be arranged between the actuation portion 43 and a catch portion 43' of the housing 5. The catch portion 43' may be referred to as a front portion of the housing 5 and the actuation portion 43 as a rear portion of the housing 5.

Figure 5:
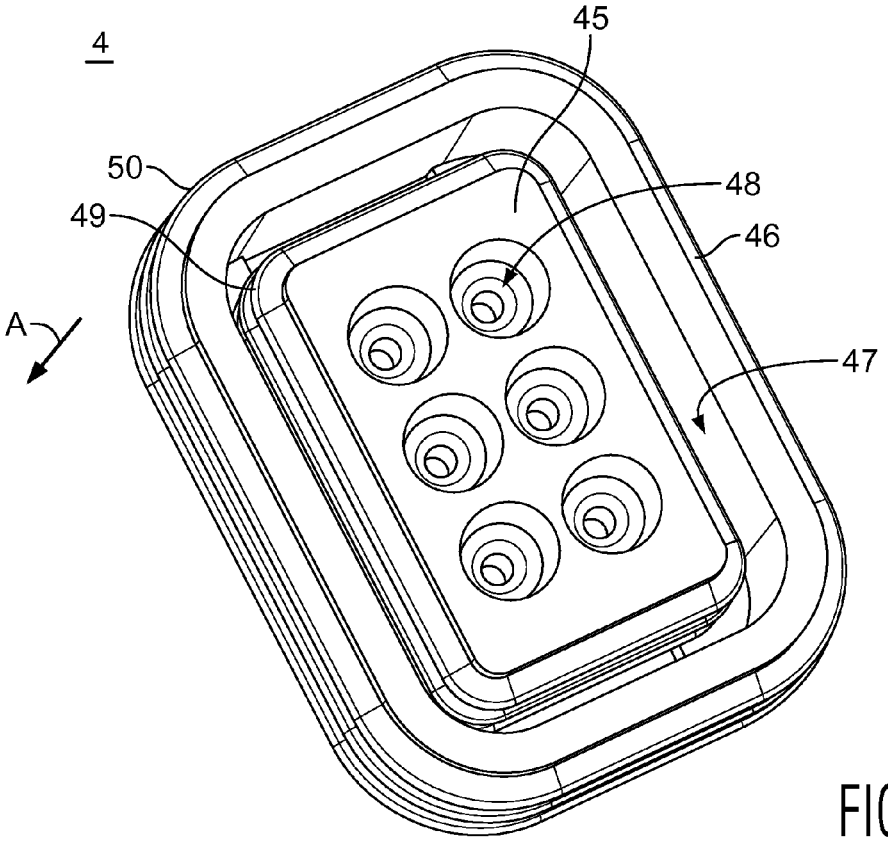
FIG. 5 is a perspective view of a seal of the plug type connector of FIG. 1.
Figure 6:
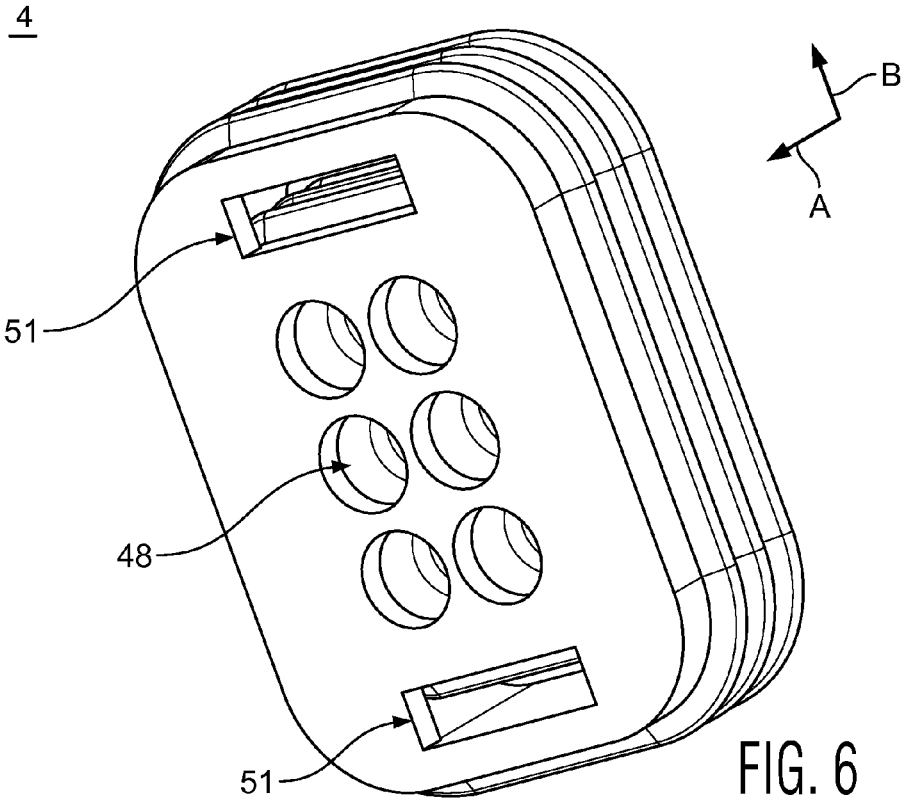
FIG. 6 is another perspective views of the seal of FIG. 5.

Now with reference to FIGS. 5 and 6, the seal 4 of the embodiment of FIG. 1 will be further discussed.

In FIG. 5, the seal 4 is provided in order to seal the plug type connector 1 against the introduction of fluids and foreign substances. The seal 4 may be constructed with an inner and an outer sealing portion 45, 46. A sealing groove 47 may be arranged between the inner and the outer sealing portion 45, 46 and extend round the inner sealing portion 45, either at least partially or even completely. A sealing channel 48 may be provided which may be aligned with the receiving chamber 14 in the assembled state of the seal 4. The sealing channel 48 may be constructed such that it can receive the contact element or a conductor which is fixed to the contact element at least partially in a sealing manner. The seal 4 may in particular includes one sealing channel 48 per receiving chamber 14.

A sealing lip 49 may protrude into the sealing groove 47 at least from the inner sealing portion 45. In addition, the outer sealing portion 46 may also be constructed with a sealing lip which protrudes into the sealing groove 47. Furthermore, the outer sealing portion 46 may be constructed with a sealing lip 50 which extends round the seal 4. Both the inner and the outer sealing portion 45, 46 may have a plurality of sealing lips 49, 50.

In FIG. 6, the seal 4 may have a receiving passageway 51 which may extend through the seal 4 and in particular open in the sealing groove 47. The receiving passageway 51 may be adapted to at least partially receive the catch arm 35 of the housing 5. If the housing 5 has more than one catch arm 35, the seal 4 may be constructed with one receiving passageway 51 per catch arm 35. If the seal 4 is formed with two receiving passageways 51, these may be arranged one behind the other. Furthermore, the a sealing channel 48 and, for example, also a group of sealing channels 48, may be arranged to extend between two receiving passageways 51 and through the inner sealing portion 45.

Figure 7:
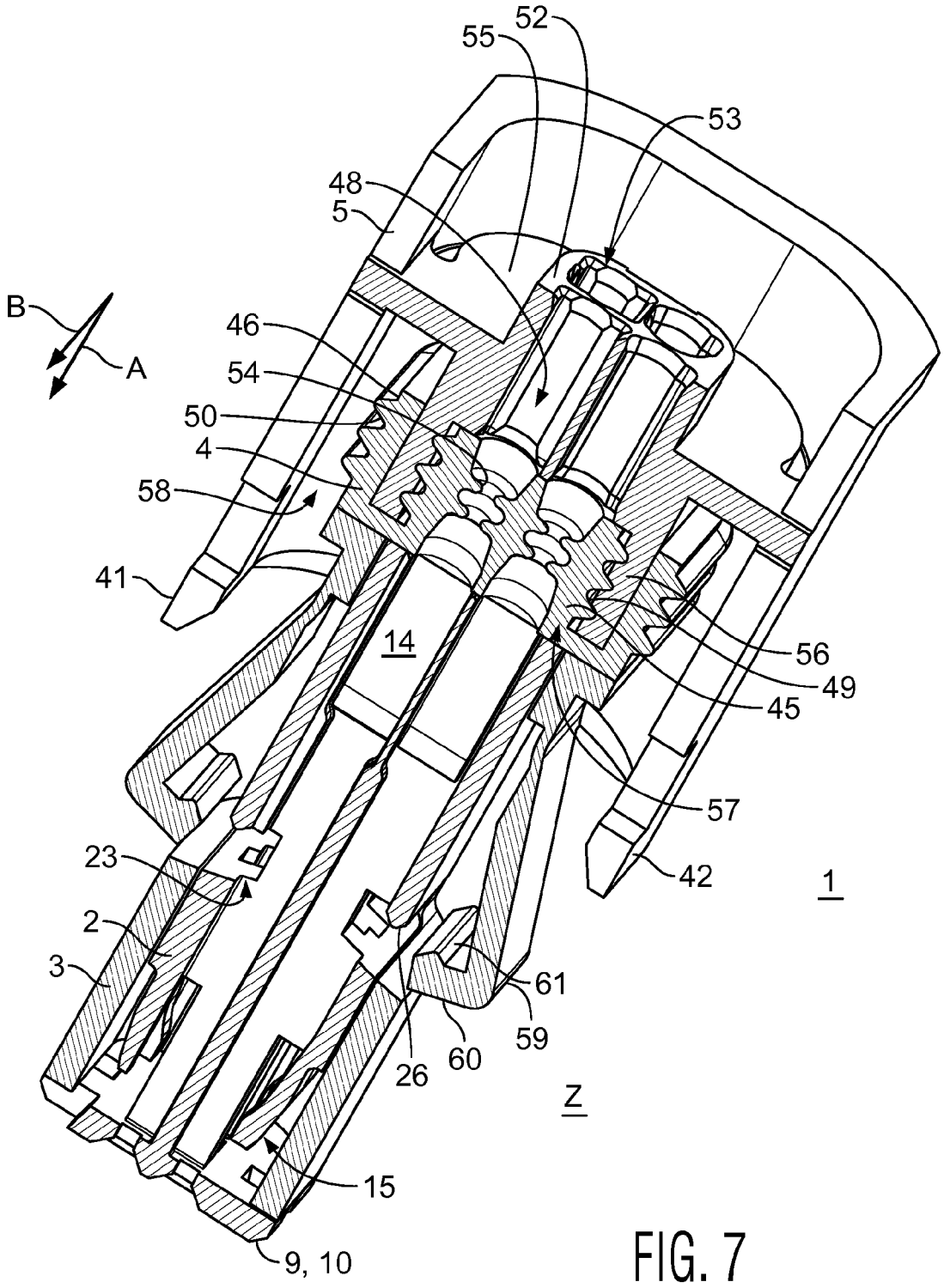
FIG. 7 is a sectional view of the plug type connector of FIG. 1.

As shown in FIG. 7, the chamber block 2, the fixing member 3, the seal 4 and the housing 5 may be arranged to be fitted one inside the other, with the chamber block 2 being at least partially arranged in the fixing member 3.

The housing 5 may be constructed with a contact connection piece 52 which may include a contact opening 53 for each receiving chamber 14. The contact opening 53 in the assembled state Z may be in alignment with the receiving chamber 14 and the sealing channel 48 so that the contact element and a conductor which is fixed to the contact element can extend in a linear manner through the plug type connector 1. It can clearly be seen that the sealing channel 48 may also have a sealing lip 54 for sealing the plug type connector 1 against the introduction of fluids or other foreign substances.

The housing 5 may be constructed with a base plate 55 that is orientated transversely relative to the receiving direction A and from which the contact connection piece 52 can protrude counter to the receiving direction A. The base plate 55 is fixed only to the material bridges 44 in order not to have a negative influence on the deformability of the housing 5 and thereby the function of the catch member 38, 38'. Alternatively, the base plate 55 may also be fixed at least partially or even completely at the edge thereof both to the material bridges 44 and to the outer shells 41, 42, whereby the rigidity of the housing 5 and the effective engagement forces of the catch member 38, 38' are increased.

The housing 5 may have a positioning rib 56 for the seal 4 downstream of the base plate 55. The positioning rib 56 may be constructed in a substantially complementary manner to the sealing groove 47 and may be constructed, for example, to be annular or crown-like. The inner sealing portion 45 of the seal 4 may be arranged in a receiving space 57 which is delimited transversely relative to the receiving direction A by the positioning rib 56, and the a sealing lip 49 thereof may abut the positioning rib 56 in a sealing manner.

The outer sealing portion 46 may extend round the positioning rib 56 outside the free receiving space 57 transversely relative to the receiving direction A. The a sealing lip 50 of the outer sealing portion 46 can protrude transversely relative to the receiving direction A away from the inner sealing portion 45 into a sealing space 58 for the connecting plug type connector. The sealing space 58 may be delimited by the positioning rib 56 and the outer shells 41, 42 transversely relative to the receiving direction A and may be open in the direction of the receiving direction A. The sealing space 58 may also extend transversely relative to the receiving direction A around the receiving space 57.

At least the recess 15, but also the additional recess 23, may be covered by the fixing member 3, when assembled. At least the catch 18 of the contact securing member 17 can thereby be protected from damage from components outside the plug type connector 1.

In order to prevent the fixing member 3 from being able to be pushed too far over the chamber block 2 in the receiving direction A, the closure collar 9 or the closure plate 10 may act as a stop for the fixing member 3.

The fixing member 3 may be constructed with a resiliently deformable contact securing arm 59 which forms an additional contact securing member and which is arranged in the rest position P' thereof completely outside the chamber block 2. The contact securing arm 59 can be constructed with a securing claw 60 which is directed inside the fixing member 3. The resiliently deformable contact securing arm 59 can be redirected transversely relative to the receiving direction A in the direction towards the chamber block 2 so that the securing claw 60 thereof is pressed into the additional recess 23.

If the securing claw 60 is pressed to the maximum extent in the direction towards the chamber block 2, it protrudes through the additional recess 23 into the receiving chamber 14. In this securing position, the securing claw 60 can prevent inadvertent displacement of the contact element. In order to ensure that the securing claw 60 does not slip out of the additional recess 23, owing to the resilient properties of the contact securing arm 59, the securing claw 60 may have a catch member 61 which is constructed for engagement with the catch 26 of the chamber block 2. For example, the catch member 61 may be formed as a catch bar.

Figure 8:
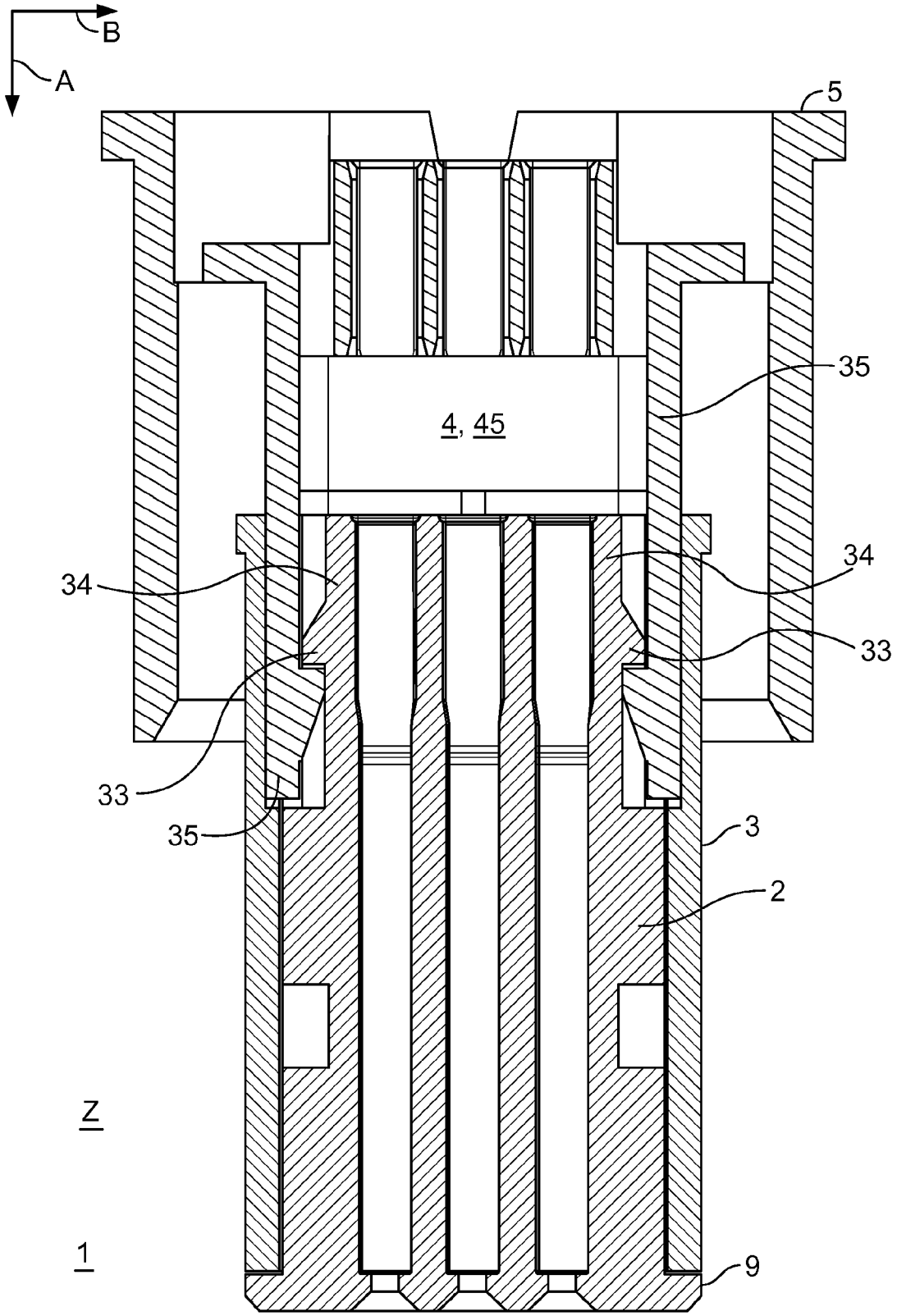
FIG. 8 is another sectional view of the plug type connector of FIG. 1.

Now with reference to FIG. 8, the plug type connector 1 is shown assembled. It can clearly be seen how the components of the plug type connector 1 are held together internally. Of the fitted components, the chamber block 2 may be considered to be the innermost component. The chamber block 2 may be inserted into the fixing member 3 at least partially. The fixing member 3 may in turn be arranged at least partially in the housing 5.

The seal 4 may be arranged between the chamber block 2 or the fixing member 3 and the housing 5.

In order to prevent the individual components of the plug type connector 1 from becoming separated, the housing 5 may be engaged with the catch portion 33 of the chamber block 2 by means of the catch arms 35. It can thereby be ensured that at least the chamber block 2 cannot readily be removed from the housing 5.

The engagement of the housing 5 and chamber block 2 requires a degree of dimensional precision of the catch arms 35 and the catch portion 33. Furthermore, it may be advantageous for the catch connection between the housing 5 and the chamber block 2 to be resiliently pretensioned by means of a force which acts counter to the catch connection in the receiving direction A. For this resilient pretensioning and in order to compensate for tolerances, the seal 4 may be constructed in a resilient manner at least parallel with the receiving direction A and be resiliently compressed by the housing 5 and the chamber block 2 or the fixing member 3. Furthermore, the seal 4 can press the fixing member 3, which is arranged between the chamber block 2 and the housing 5, resiliently against the closure collar 9. The fixing member 3 is thus prevented from being poorly positioned parallel and from potentially rattling.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A plug type connector comprising:

a chamber block having a receiving chamber extending a length of the chamber block and including a contact securing member with a catch, a first recess intersecting with the receiving chamber and having an opening into which the catch protrudes, and a second recess intersecting with the receiving chamber and separated from the first recess by a base member of the chamber block.

2. The plug type connector according to claim 1, further comprising a closure collar extending from the base member.

3. The plug type connector according to claim 2, wherein the receiving chamber is partially delimited by a stop formed on the closure collar.

4. The plug type connector according to claim 2, wherein the closure collar includes an access opening to the first recess.

5. The plug type connector according to claim 4, wherein the access opening is spaced apart from a contact opening of the receiving chamber.

6. The plug type connector according claim 1, further comprising a fixing member having a chamber block receiving space.

7. The plug type connector according to claim 6, wherein the fixing member includes a resiliently deflectable contact securing arm engageable with the second recess.

8. The plug type connector according to claim 1, further comprising a housing having a chamber block receiving opening and a catch arm securing the chamber block.

9. The plug type connector according to claim 8, wherein the housing includes a pair of outer shells separated from each other by a separation gap and a resilient material bridge connecting the pair of outer shells.

10. The plug type connector according to claim 9, further comprising a catch member disposed in the separation gap along one side of the pair of outer shells.

11. The plug type connector according to claim 1, further comprising a seal having a sealing channel adjoining with the receiving chamber.

* * * * *